US007896945B2

(12) United States Patent
Sayad-Yaghoubi

(10) Patent No.: US 7,896,945 B2
(45) Date of Patent: Mar. 1, 2011

(54) CARBOTHERMIC PROCESSES

(75) Inventor: Yaghoub Sayad-Yaghoubi, Mt. Waverly (AU)

(73) Assignee: Thermical IP Pty Ltd., Victoria (AU)

( * ) Notice: Subject to any disclaimer, the term of this patent is extended or adjusted under 35 U.S.C. 154(b) by 0 days.

(21) Appl. No.: 12/448,707

(22) PCT Filed: Dec. 21, 2007

(86) PCT No.: PCT/AU2007/001986

§ 371 (c)(1),
(2), (4) Date: Sep. 30, 2009

(87) PCT Pub. No.: WO2008/080188

PCT Pub. Date: Jul. 10, 2008

(65) Prior Publication Data

US 2010/0064850 A1 Mar. 18, 2010

(30) Foreign Application Priority Data

Jan. 2, 2007 (AU) ..... 2007900009

(51) Int. Cl.
*C22B 21/02* (2006.01)

(52) U.S. Cl. ..... 75/674; 75/10.27; 75/10.18; 423/129; 423/137

(58) Field of Classification Search ..... 75/674, 75/10.27, 10.18; 423/129, 137
See application file for complete search history.

(56) References Cited

U.S. PATENT DOCUMENTS

| | | | | |
|---|---|---|---|---|
| 4,385,930 | A | 5/1983 | Persson | |
| 4,490,169 | A * | 12/1984 | Persson | 75/10.61 |
| 6,361,580 | B1 * | 3/2002 | Plahte et al. | 75/10.21 |
| 6,805,723 | B2 * | 10/2004 | Aune et al. | 75/10.27 |
| 6,849,101 | B1 * | 2/2005 | Fruehan et al. | 75/10.27 |
| 2002/0170387 | A1 | 11/2002 | Lindstad | |

OTHER PUBLICATIONS

International Search Report for International Patent Application No. PCT/AU07/01986 dated Feb. 27, 2008.

* cited by examiner

*Primary Examiner* — George Wyszomierski
*Assistant Examiner* — Tima M McGuthry-Banks
(74) *Attorney, Agent, or Firm* — Ohlandt, Greeley, Ruggiero & Perle, LLP

(57) ABSTRACT

A mass of solid aluminium carbide containing product is produced by injecting particulate alumina into a bath (30) of molten aluminium metal; and injecting carbonaceous material, consisting of, containing or yielding carbon, into the bath (30). The bath (30) of molten aluminium metal is maintained at a superheated temperature to heat and react carbon with molten aluminium to produce solid aluminium carbide which mixes with alumina to form a mass (36) containing entrapped gas and entrapped molten aluminium metal and having a bulk or apparent density less than aluminium. The mass is allowed to accumulate as a mass of solid aluminium carbide containing product on the upper surface of the bath. The carbonaceous material is a hydrocarbon material or is produced by pyrolysis, decomposition or cracking of a hydrocarbon material.

21 Claims, 2 Drawing Sheets

CARBOTHERMIC PROCESSES

FIELD OF THE INVENTION

This invention relates to carbothermic reactions involving alumina.

BACKGROUND OF THE INVENTION

For aluminium production, technology based on a carbothermic process is promising and offers the prospect of an alternative to the Hall-Héroult electrolytic technology. A successful carbothermic process would have the potential to reduce capital investment requirements by 50 to 70% and operating costs by 25 to 35% compared to the electrolytic route. Also, the problem of fluoride emission would be obviated, while the quantity of generated carbon containing gases would be substantially lower than for electrolytic production of aluminium.

Attempts to produce aluminium by a carbothermic process have been made for in excess of 100 years. However, optimisation of a carbothermic process to enable successful commercial production of aluminium is yet to be achieved.

Processes investigated to this stage require temperatures in excess of 2000° C. and accurate control of reactants and products at different complex stages. The stages include:

(a) reaction of alumina and carbon to produce aluminium carbide at above 2000° C.;

(b) reaction of the aluminium carbide with alumina to produce aluminium metal at above 2150° C.; and (c) separation of the aluminium from remaining materials.

Challenges to be met in such carbothermic process include successfully recovering the high level of volatilized aluminium, reducing the level of refractory loss, the difficulties of transferring materials between stages and the problem of generation of a high volume of carbon monoxide. Such issues are inevitable at operating temperatures as high as 2000 to 2250° C.

Reactions central to the carbothermic processes are:

$$2Al_2O_3+9C \rightarrow Al_4C_3+6CO, \quad (1) \text{ and}$$

$$Al_2O_3+Al_4C_3 \rightarrow 6Al+3CO \quad (2)$$

These reactions give the overall reaction of:

$$Al_2O_3+3C \rightarrow 2Al+3CO \quad (3)$$

Earlier work on the production of aluminium by these reactions is illustrated by U.S. Pat. Nos. 1,219,797 and 1,222,593 both to Barnet et al; U.S. Pat. Nos. 2,090,451 and 2,255,549 both to Kruh; U.S. Pat. No. 2,755,178 to Rasmussen; U.S. Pat. No. 2,776,884 to Grunert alone; and U.S. Pat. No. 2,829,961 to Miller at al; and U.S. Pat. No. 2,974,032 to Grunert. More recent work has been directed to reacting alumina and carbon in a molten bath having a molten slag of aluminium carbide and alumina. The molten bath usually operates with two zones, in a first of which aluminium carbide is generated, and a second to which the carbide passes to be reacted with alumina to produce metallic aluminium. This work is illustrated by U.S. Pat. No. 4,385,930 to Persson; U.S. Pat. No. 6,440,193 to Johansen et al; U.S. Pat. No. 6,475,260 to LaCarmera; U.S. Pat. No. 6,530,970 to Lindstad; U.S. Pat. No. 6,849,101 to Fruehan et al; and US patent application publication 2006/0042413. Also of interest are the publications: "Carbothermal Production of Aluminium" by Motzfeldt et al, published in 1989 by Aluminium-Verlag GmbH of Düsseldorf, Germany; and "Aluminium Carbothermic Technology" submitted to US Department of Energy under Cooperative Agreement Number DE-FC36-00ID13900 by M J Bruno and Alcoa Inc, and dated 31 Dec. 2004.

SUMMARY OF THE INVENTION

The present invention is directed to providing an alternative to the approaches adopted in the prior art considered in the "Background of the Invention" set out earlier herein. The present invention also seeks to provide an alternative to the process disclosed in my earlier application PCT/AU2006/001048, filed on 27 Jul. 2006, the disclosure of which is incorporated herein by reference to be read as part of the present disclosure. As with the process of PCT/AU2006/001048, the approach adopted by the present invention has a number of advantages over the prior art, as will become clear in the following description. However, in brief, the advantages include the ability to produce aluminium carbide at relatively low temperatures compared with temperatures necessary in the prior art, and the ability to produce aluminium carbide and then to produce metallic aluminium from that carbide in an overall process which generates less aluminium vapour than the prior art.

In accordance with a first aspect, the present invention provides a process for producing a mass of solid aluminium carbide containing product, wherein the process includes the steps of:

(a) injecting particulate alumina into a bath of molten aluminium metal;

(b) injecting carbonaceous material (that is, material consisting of, containing or yielding carbon) into the bath of molten aluminium metal;

(c) maintaining the bath of molten aluminium metal at a superheated temperature sufficient to heat and react carbon of the carbonaceous material with molten aluminium of the bath to produce solid aluminium carbide which mixes with alumina to form a mass containing entrapped gas and entrapped molten aluminium metal and having a bulk or apparent density less than the aluminium of the bath; and (d) allowing the mass of solid aluminium carbide mixed with alumina, containing gas and aluminium metal, to accumulate as a mass of solid aluminium carbide containing product on the upper surface of the bath;

wherein the carbonaceous material is a hydrocarbon material or is produced by pyrolysis, decomposition or cracking of a hydrocarbon material.

Carbon of the source results in the production of aluminium carbide by the reaction:

$$4Al+3C \rightarrow Al_4C_3 \quad (4)$$

This reaction is noticeable at about 1100° C. However, it proceeds with higher kinetics above 1400° C. The reaction is exothermic and, in contrast to the carbide forming reaction of equation (1) above, it does not produce any carbon monoxide gas. This is a very significant advantage for the present invention, as the reaction of equation (1) produces two-thirds of the substantial volume of carbon monoxide produced in the prior art carbothermic processes.

As the carbonaceous material and particulate alumina are injected, the reaction of equation (4) occurs in the presence of alumina in the molten aluminium of the bath. As a consequence, the solid aluminium carbide produced by the reaction of equation (4) is able to attach to alumina particles, to produce the mass of aluminium carbide containing product having entrapped gas and aluminium metal and with a bulk or apparent density less than the density of the molten aluminium metal.

In a first form of the invention, the carbonaceous material injected into the bath of molten aluminium is at least partially a hydrocarbon material, consisting of at least one hydrocarbon, which is injected directly into the bath of molten aluminium. The carbonaceous material may substantially comprise hydrocarbon material. Alternatively, the carbonaceous material may include particulate carbon material, that is, free or elemental carbon-containing material, combined with hydrocarbon material. In each case, the hydrocarbon material may substantially comprise a single hydrocarbon, or it may substantially comprise a mixture of at least two hydrocarbons.

In a second form of the invention, the carbonaceous material injected into the bath of molten aluminium at least partially includes carbon containing material produced by at least partial pyrolysis, decomposition or cracking of a hydrocarbon material. In that second form, the carbon of the carbon containing material may be elemental carbon, such as in the form of soot, or it may be lower order hydrocarbon material or a mixture of elemental carbon and lower order hydrocarbon material. By lower order hydrocarbon material is meant hydrocarbon material which has a lower average molecular weight than initial higher order hydrocarbon material subjected to pyrolysis, decomposition or cracking to produce the lower order material. As in the first form of the invention, particulate carbon may be combined with the carbon containing material.

In the second form of the invention, the carbonaceous material as produced by pyrolysis, decomposition or cracking will include other material, most particularly hydrogen. At least part of the hydrogen may be used as a carrier gas with which the carbonaceous material is injected into the bath of molten aluminium. Preferably all of the hydrogen is used as a carrier gas. However, at least where the carbonaceous material is elemental carbon, at least part of the hydrogen is able to be separated and used or sold for other purposes. Thus, for example, where the carbonaceous material as produced at least substantially comprises elemental carbon and hydrogen, the mixture of carbon and hydrogen may be separated by collecting carbon in bag filters, after which part of the hydrogen is able to be separated for another use with the balance recycled to entrain the carbon for injection into the molten aluminium. While the total volume of hydrogen as produced can be retained and injected with the carbon, such separation of part of the hydrogen can be useful. Also, if a greater volume of carrier gas is necessary than is provided by recycled hydrogen, argon can be added to the recycled hydrogen to increase the volume of carrier gas.

In the first form of the invention, the hydrocarbon injected directly into the bath of molten aluminium is reacted in situ. That is, the hydrocarbon is able to react directly with the aluminium, or it is pyrolized, decomposed or cracked in situ to produce elemental carbon and/or lower order hydrocarbon which reacts in situ with the aluminium. In the case of elemental carbon, the reaction with molten aluminium is as shown by reaction (4) above. In the hydrocarbon material, whether it is that initially injected or lower order hydrocarbon, an effective generic reaction can be represented as:

$$3C_nH_{2(n+1)}+4nAl \rightarrow nAl_4C_3+3(n+1)H_2 \quad (5)$$

Thus, specifically for use of methane as the hydrocarbon, the reaction is $$3CH_4+4Al \rightarrow Al_4C_3+6H_2 \quad (6)$$

A gaseous, liquid or solid hydrocarbon may pyrolyse, decompose or crack at high temperatures. For an alphatic compound, this can be represented by:

$$C_nH_{2(n+1)} \rightarrow nC+(n+1)H_2 \quad (7)$$

Specifically for methane, the reaction is:

$$CH_4 \rightarrow C+2H_2 \quad (8)$$

However, the rate of carbon extraction from a high temperature flow of hydrocarbons can be enhanced by a medium which has affinity for the carbon. At equilibrium the value of hydrogen is several orders of magnitude higher than the reacting methane when aluminium is present.

Reactions (5) to (8) relate to unsubstituted aliphatic compounds. However, similar generic and specific reactions apply for other hydrocarbons. Also, unsubstituted hydrocarbons, that is those substantially free of elements other than carbon and hydrogen, are preferred as they obviate possible undesired reaction with the aluminium, carbon and/or alumina and resultant contamination of the bath or the aluminium carbide.

Reaction (7) shows complete breakdown of injected hydrocarbon material into its constituent elements. The breakdown, of course, may be partial or proceed to a complete breakdown in more than one step. Lower order hydrocarbon material produced may breakdown further, or be consumed by reactions such as reactions (5) and/or (8).

In the second form of the invention, reactions such as partly illustrated by reactions (7) and (8) are caused to occur outside the bath of molten aluminium. Following this elemental carbon and/or lower order hydrocarbon material, with at least part of the hydrogen produced, is injected into the molten aluminium, resulting in reactions including one or more of reactions (4) to (8).

In each of the first and second forms of the invention the carbonaceous material, as injected into the bath of molten aluminium, may be a gas, a liquid, a solid in an injectable form, or a mixture of at least two of gas, liquid and injectable solid material. In order to be injectable, the solid material needs to be in a suitable particulate form.

The particulate alumina and the carbonaceous material injected into the bath of molten aluminium may be injected at the same or respective locations. In each case, aluminium carbide produced is required to mix with alumina in order to form the required mass of solid aluminium carbide mixed with alumina. Where the injected carbonaceous material is a fluid, the particulate alumina may be entrained in the fluid carbonaceous material to facilitate injection of the alumina.

As indicated, the carbonaceous material injected into the molten aluminium in the second form of the invention may be or include elemental carbon, such as soot, entrained in hydrogen. This form of carbonaceous material can be produced by a form of the commercial process used for many years to produce carbon black. In that commercial process, a methane-air flame is used to heat a brick furnace to a sufficient temperature, the air supply then is terminated to enable methane to decompose in the hot furnace by reaction (8), after which the furnace is cooled for recovery of the soot. The hydrogen produced by that reaction is combusted to heat the furnace and methane feed but, in adopting this process for producing carbonaceous material for the second form of the invention, at least part of the hydrogen would be used as a carrier gas in which the carbonaceous material is entrained for injection into the aluminium.

In a variant of the carbon black process, for use in the second form of the invention, methane can be decomposed in hot particulate alumina, such as alumina maintained in a fluidized bed by injection of the methane. The resultant carbon soot is collected on the alumina particles and the hydrogen, produced by the decomposition of the methane, can be used as a carrier gas in which the alumina and collected carbon is entrained and injected into the aluminium.

As hydrocarbons decompose and crack (Equations 5 and 6), the solid carbon is finely dispersed in the hydrogen gas produced. This carbon has a small particle size (such as 20-500μ) and a high surface area (for example 1-10 $m^2/g$). The carbon is very reactive and has been found to react with molten aluminium at high temperatures and produce aluminium carbide. Moreover, it has been found that the aluminium carbide can be produced in the presence of particulate alumina to form the mass required by the present invention.

The particulate alumina, and the particulate carbon where used, has a particle size sufficiently small as to facilitate efficient injection into the bath in an entraining carrier fluid. The alumina may be of a grade suitable for use in the electrolytic process for recovery of aluminium and, as in that use, it may be a relatively fine powder. The particulate carbon may be petroleum coke. Alternatively, the particulate carbon may be charcoal. Whether of coke, charcoal or some other carbon type, it is desirable that the content of silica be low, such as below 0.3 wt %.

The bath of molten aluminium is maintained at a superheated temperature at which the carbon of the injected carbonaceous material is able to react with molten aluminium to generate aluminium carbide. To achieve a sufficient rate of reaction, the bath temperature preferably is in excess of about 1400° C., such as from about 1550° C. to 1650° C.

It is found that the injection step of the present invention is able to proceed safely. The step is able to be conducted without the need for special requirements beyond those normally used in pyrometallurgical processes with similar or higher operating temperatures. Indeed, higher temperatures in excess of about 1650° C. can be used, although such higher temperatures preferably are avoided as they add unnecessarily to operating costs. The procedures for the injection step are similar to those used in steelmaking in a basic oxygen furnace (BOF), in which such procedures are well established and used under more extreme conditions.

Injection into the bath of carbonaceous material and alumina, separately or together entrained in a carrier fluid, results in dispersal of carbon and alumina throughout at least a region of the molten aluminium. Thus, as the aluminium and carbon react to form solid aluminium carbide, particles of the alumina and aluminium carbide are intimately mixed and become attached to form a mass comprising the solid aluminium carbide containing product. Small volumes of aluminium metal inevitably become entrapped in the forming mass. As gas also is dispersed with the carbon and alumina, pockets of gas become entrapped in the forming mass. The entrapped gas may substantially comprise hydrogen which results from hydrocarbon being pyrolyzed, decomposed or cracked prior to or when exposed to the high temperature of the bath.

As indicated, the hydrocarbon can be methane. The hydrocarbon alternatively may be ethane, propane, butane, pentane, higher alkanes, or mixtures of such hydrocarbons, such as in natural hydrocarbon gases and petroleum liquids gases, alkenes such as ethylene, butylene and trimethylethylene. A single hydrocarbon or a mixture of at least two hydrocarbons can be used. The hydrocarbon may be a liquid or even a solid, able to be heated to form a carbon containing carrier gas, such as higher alkanes and alkenes. In the case of tar pitch and other liquid and solid hydrocarbons, decomposition and thermal cracking may result in the generation of gaseous hydrocarbons, in some instances with generation of hydrogen and carbon. To the extent that this occurs, the hydrocarbon providing the source of carbon may be or become gaseous. However, at least at the moment of being injected into the bath of molten aluminium, some liquid hydrocarbon may be present, such as in the form of a spray of droplets, and it therefore is appropriate to consider the range of injectable hydrocarbons as being liquid and/or gaseous and, hence, as being a fluid. This also covers the use of particulate solid hydrocarbon, even if its decomposition and thermal cracking does not commence until it has been injected into the molten aluminium, since the particulate solid hydrocarbon will need to be in a fluid condition as a consequence of being entrained in a carrier gas. The entraining carrier gas itself may be a hydrocarbon or it may be an inert gas such as argon or hydrogen.

The nature of the mass comprising the solid aluminium carbide containing product formed by the injection into molten aluminium facilitates the recovery of aluminium metal by the reaction of equation (2). The mass contains aluminium carbide and alumina, the reactants for equation (2). By controlling the ratio of carbon to alumina provided by the injected into the molten aluminium, the ratio of aluminium carbide to alumina in the mass can be controlled to satisfy the requirements for equation (2). In this regard, allowance will need to be made for the extent to which carbon also is caught up in the mass, as this will be available to react with pockets of aluminium metal in accordance with equation (4) to produce further aluminium carbide.

In accordance with a further aspect, the present invention also provides a process for the recovery of aluminium metal. In this, aluminium carbide containing product is produced in a first zone in accordance with the first aspect of the present invention, and the aluminium carbide containing product is heated in a second zone to react the aluminium carbide and alumina of the product to produce aluminium metal and carbon monoxide.

The second zone, in which the aluminium carbide containing product is heated, may be spaced from a reaction vessel in which that product is formed. That is, the aluminium carbide containing product may be transferred to a separate, second reaction vessel in which it is heated. However, significant benefits are able to be achieved by heating the aluminium carbide containing product in the same installation as that in which it is formed. Not the least of these benefits are avoidance of the need to move the product from one vessel to another, and minimisation of heat energy loss prior to heating the product in the second zone to recover aluminium metal by the reaction of equation (2).

The second zone preferably is immediately above the first zone in which the aluminium carbide containing product is formed such that, as the product accumulates on the upper surface of the bath, it is able to enter the second zone. Thus, the first and second zones may be defined by vertically adjacent reactors of a single reaction vessel or separate but vertically adjacent reactors of a single reactor installation. As a consequence, aluminium metal produced by the reaction of equation (2) is able to flow to the bath of molten aluminium. Thus, aluminium from the bath that is consumed by the formation of aluminium carbide in the first zone is returned to the bath. Aluminium produced by the consumption of alumina in the second zone adds to the aluminium content of the bath, necessitating tapping of aluminium.

The aluminium carbide containing product may be heated in any suitable way. The product may be heated electrically. Induction heating is possible, as the aluminium carbide containing product is conductive and enables inductive heating of the product. However, electric arc heating is the preferred and most practical form of heating.

In a preferred arrangement, the second zone in which the aluminium carbide containing product is heated is in the form of an electric arc furnace (EAF) which has a plurality of electrodes to provide electrical energy for heating the product. The EAF is positioned above the bath and has an opening at its base into which the aluminium carbide containing product is able to locate as it forms. The electrodes are arranged such that each generates an arc at the upper part of the aluminium carbide containing product to provide a region of intense local heating at which the aluminium carbide and alumina of the product are caused to react.

The intense local heating at an arc generated by each electrode may result in a very high temperature. However, the temperature of the aluminium carbide containing product decreases with the distance away from the arcs. Preferably the arrangement is such that the intense localised heating is submerged, such that, around the periphery of the EAF, the temperature of the aluminium carbide containing product is as low as about 1000 to 1300° C. With this arrangement the main body of the product around the electrodes will be at a temperature of from about 1700° C. to 2000° C. Heating within this range is found to be sufficient to enable the reaction of equation (2) to proceed at an acceptable rate for the recovery of aluminium metal, at least under preferred conditions permitted by the present invention.

In a preferred form of the invention which enhances the rate of the reaction of equation (2) at a temperature as low as about 1700° C., carbon monoxide is removed from the upper surface of the aluminium carbide containing product and from the region of intense local heating generated by the arcs. This can be achieved by:

(a) maintaining a sufficiently low gas pressure in the second zone, above the aluminium carbide containing product to extract carbon monoxide; and
(b) flushing upper surface of the aluminium carbide containing product, including the region of intense local heating generated by the arcs, with hydrogen or, if argon is used, a combination of argon and hydrogen.

Most preferably the carbon monoxide is removed by a combination of operating with a reduced pressure above the aluminium carbide containing product and flushing the upper surface of that product with hydrogen or a combination of argon and hydrogen.

The removal of carbon monoxide favours the forward reaction of equation (2). The extent to which this occurs is such that the reaction proceeds at an acceptable rate at temperatures of from about 1700° C. to 2000° C. Thus, contrary to prior art proposals, it is not necessary to operate at a temperature above 2150° C. to enable the reaction of equation (2) to proceed.

The first and second zones preferably are in a sealed installation sufficient to prevent the ingress of atmospheric air. A gas space of the second zone, above the aluminium carbide containing product, may communicate with a vacuum generating system operable to reduce the pressure in the gas space to a suitable level. A sufficiently reduced pressure enables the forward reaction of equation (2) to proceed at a sufficient rate at about 1700° C.

A reduced pressure above the aluminium carbide containing product causes gas to be drawn upwardly through that product. Thus, gas from the stream injected into or generated in the bath of molten aluminium is able to evolve from the bath and then be drawn through that product. The gas, consisting of hydrogen or a mixture of argon and hydrogen, flushes carbon monoxide away from the upper surface of the aluminium carbide containing product. However, if the flushing action of this gas is insufficient, argon or hydrogen can be blown down onto the upper surface of the aluminium carbide containing product to thereby flush carbon monoxide away from that upper surface. The blown gas may be supplied through a lance extending into the second zone or through a longitudinal passage defined within each electrode.

In order that the invention may more readily be understood, reference is made to the accompanying drawing which is a schematic sectional view of a reactor installation for use in the process of the present invention.

The starting point for the present invention was my experimental work using argon as a carrier gas for the injection of alumina and carbon into molten aluminium, and as an inert gas to dilute carbon monoxide generated when heating resultant solid aluminium carbide containing mass to produce aluminium. The possibility of using gaseous, liquid or solid hydrocarbons in providing an alternative for argon necessitated investigation of the essentially unexplored thermodynamics of the aluminium and hydrocarbon system and further experimental work. As previously indicated with reference to equations (5) to (8), hydrocarbons in gaseous form, or able to be converted by volatilization, decomposition or cracking to a gas phase, offers the possibility of generating a gas phase suitable for use as an alternative for argon for use as a carrier gas and for providing a carbon source.

Figure 1:
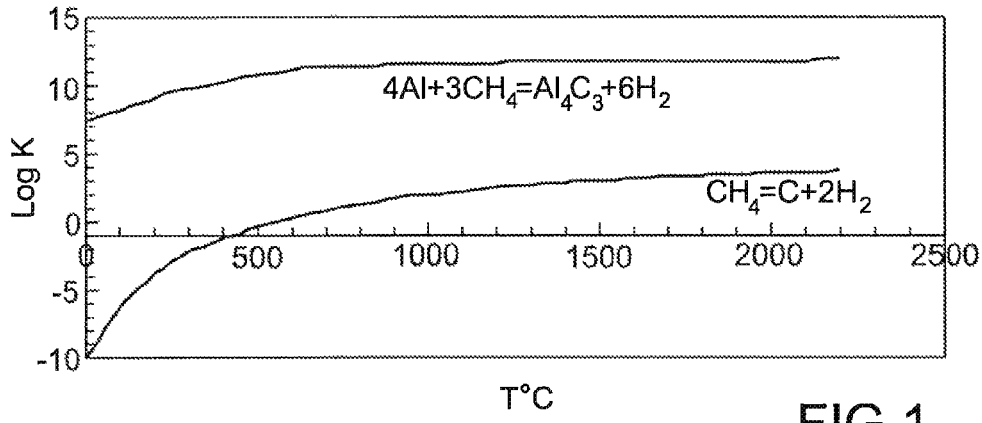
FIG. 1 shows a plot of the equilibrium constant against temperature for reactions (6) and (8)

FIG. 1 shows the thermodynamic potential for reactions (6) and (8). For reaction (6), the potential is higher than for reaction (8). Therefore, the rate of carbon extraction from a high temperature flow of hydrocarbon can be enhanced by molten aluminium as a medium which has affinity for the carbon.

As hydrocarbons such as methane decompose and thermally crack by equations (7) and (8), finely dispersed carbon is produced, while hydrogen gas is liberated. The finely dispersed carbon has a small particle size, such as from about 20 μm to about 500 μm, and a high surface area, such as from about 1 to 10 $m^2/g$. The carbon is very reactive and, when the decomposition and thermal cracking results from the injection of hydrocarbon into molten aluminium, aluminium carbide is produced by reaction (4). The overall effect of the hydrocarbon injection is as represented by reactions (5) and (6).

Experiments were conducted to determine the viability of injecting methane gas into molten aluminium in order to produce solid aluminium carbide. The experiments were carried out in graphite crucibles. A quantity of solid aluminium was placed in each crucible. The crucible then was covered by an alumina cap through which a central hole had been drilled. After locating the cap on a crucible, the peripheral interface between the rim of the crucible and the cap was sealed using a silicon carbide paste. A thermocouple then was secured to the crucible to enable temperature measurements to be made.

An alumina tube to be used as a lance for injecting methane into a crucible was lowered endwise through the hole in the alumina cap of the crucible. The crucible then was placed in a heating chamber in which it was heated to heat and melt the aluminium. The aluminium was heated and melted to a required temperature level above its melting point. On attainment of that temperature level, the alumina tube was lowered to submerge its lower end in the molten aluminium and methane then was injected into the aluminium, via the tube. The intention was to produce solid aluminium carbide, by the reaction of equation (6) or by a combination of the reactions of equation (8) and equation (4), with evolution of hydrogen gas. To ensure removal of hydrogen generated, and prevent hydrogen pressure build-up in the heating chamber, a refractory cover with several vents had been fitted over the chamber prior to the commencement of methane supply.

The injection was continued for a sufficient period of time, based on the consumption of methane relative to a set proportion of the aluminium. The quantity of aluminium occupied about half the volume enclosed by the sealed crucible and its cap, to provide for the increased space required for solid reaction product. At the end of that period, methane injection was terminated, and the crucible and its content was allowed to cool in the heating chamber. When cool, the crucible was removed and broken open to enable examination of its contents.

The contents from the crucible was found to be a unitary solid mass. The lower part of the mass was aluminium accounting for about half of the initial weight of the metal put in the crucible. Throughout the metal, there were particles determined to be aluminium carbide which evidently had been dispersed by the injected methane. Above the aluminium metal, the mass was determined to substantially comprise aluminium carbide containing minor proportions of entrapped aluminium from the melt and fine carbon particles.

It was found that a minimum molten aluminium superheat temperature of about 1050° C. was desirable. Below this level, the rate of reaction tended to be slow. At temperatures up to about 1200° C., the aluminium carbide was in a fine and fibrous layered structure. Above about 1200° C., the carbide was found to be more coalesced than fibrous, with dense carbide layers separated by thin layers of aluminium metal. The aluminium carbide layers contained deposited carbon, although overall, deposited carbon tended to decrease with increasing reaction temperature. Some carbon also was found on internal surfaces of the crucible, about the melt level, and of the cap.

At temperatures above about 1050° C., it was observed that the carbide formation was rapid, indicating high reactivity of the carbon available from the injected methane gas. At lower temperatures, at which carbide formation was not extensive or at which the aluminium had not been melted, extensive carbon deposition was found to have occurred.

In one series of trials, conducted at 1050° C., methane was injected at different flow rates ranging from 400 to 1000 ml/min. In each case, a layered aluminium carbide structure was found to have been formed on and pushed up from the surface of the molten aluminium, with carbon deposited on the layered structure and on the internal surfaces of the crucible and its cap. Variation in methane flow rate was not found to have produced any significant difference in performance.

As indicated, the deposition of carbon was found to decrease with increasing temperature, indicating an increasing rate of reaction (4) with increasing temperature. The increasing tendency for a fibrous, layered carbide structure below about 1200° C. appears to be attributable to limited nucleation and growth of the carbide.

In these trials, it was noticed that the injection of methane and the resultant production of aluminium carbide did not have any significant influence on the heat input required by the system. That is, they did not change substantially the temperature profile of the system. This observation is consistent with the thermal balance for carbide formation which requires three moles of methane for each mole of aluminium carbide produced, as shown by the reaction of equation (6). The heat balance for that reaction shows that the heat required for cracking three moles of methane (about 66.5 kcal) is only slightly higher than the heat generated by formation of one mole of aluminium carbide (about 66.0 kcal). Based on this heat balance, it was clear that injecting methane gas in molten aluminium would not have any significant effect on the temperature profile of the system and would not create an energy balance control problem. The only required precaution was related to hydrogen generation. In this process two volumes of hydrogen are produced from each volume of the gas injected in the system. This could build up a pressure in the heating chamber. However, providing sufficient ventilation ensured safe experimental conditions able to be replicated in operation on a commercial scale.

The generated aluminium carbide product was very fine, and well suited to mix with particulate alumina wetted by molten aluminium. Thus, the aluminium carbide is well suited for production under conditions for the process of the first aspect of the present invention to produce a mass of solid aluminium carbide containing mass in which the carbide is mixed with alumina. Similarly, the aluminium carbide is well suited for use in the production of aluminium metal according to the second aspect of the present invention.

To produce a stoichiometric aluminium carbide containing mass, one mole of alumina and three moles of carbon are required. Thus, if methane is used as the only carbon source, 67.2 liters of methane at STP will be needed. In contrast, the required volume of argon to carry the same amount of material need only be about three to four liters. Carbonaceous material comprising methane and other hydrocarbons can be used as a carrier for alumina, as well as a carbon source. A hydrocarbon can supply a part or all of the required carbon. Also, hydrocarbons are able to provide very pure and reactive carbon, and unwanted impurities can be avoided.

Injection of high volumes of hydrocarbon into molten aluminium in a reactor is able to induce high agitation and better mixing in an aluminium carbide mass generation zone of the reactor. At the same time, production of hydrogen gas can be used to dilute the reactor CO atmosphere in a metal production zone. If methane is used as the only carbon source, the required volume of the methane would be about 1250 $Nm^3$ for production of each tonne of aluminium. This volume of methane will generate about 2500 $m^3$ hydrogen in the reactor. This volume of hydrogen is two times higher than the carbon monoxide gas generated in the reactor for each tonne of the metal produced. Therefore hydrogen is able to dilute the gas phase and lower the reaction temperature for aluminium production.

Using methane as the only source of carbon enables reduction in the cost of an off-gas treatment unit. An off-gas of $CO\text{-}2H_2$ composition can be used for power generation. Reducing the methane volume in the reactor will enrich the CO content in the exit gas and the required level of evacuation will be higher.

Figure 2:
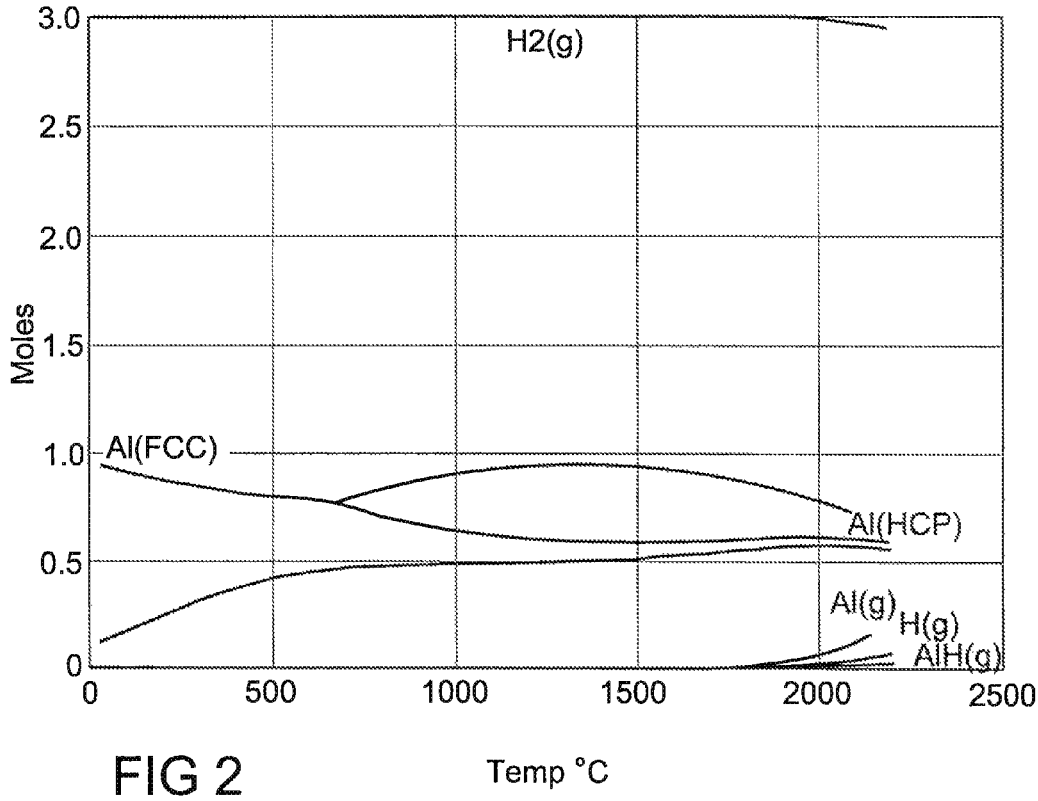
FIG. 2 shows thermodynamic results for the Al-3$H_2$ system.

The hydrogen produced in the reactor will not react with aluminium or aluminium compounds to any substantial degree. FIG. 2 shows the $Al\text{-}3H_2$ system over the range of 0° C. to 2500° C. Based on thermodynamic calculations in this system, it is found that a small amount of atomic hydrogen and a lesser degree aluminium hydrate are produced at above 2000° C.

In the process of the first aspect of the present invention and the corresponding aluminium carbide producing stage of the process of the second aspect of the invention, operation preferably is in the temperature range of 1550° C. to 1650° C. That is, the molten aluminium which is exposed to hydrogen gas preferably is at a temperature in that range. As indicated by FIG. 2, neither atomic hydrogen nor aluminium hydrate are expected to be generated at the temperatures of that range.

Higher temperatures are necessary for atomic hydrogen and aluminium hydrate to be present.

Higher temperatures can be generated in the aluminium metal producing stage of the process of the second aspect of the present invention. This is particularly the case if a submerged arc is used in the metal production zone, and some atomic hydrogen can be present at the arc sites and aluminium hydrate can be produced at those sites. However, it is found that the hydrate and hydrogen dissolved in molten aluminium above about 1400° C. in the presence of alumina will react according to the equation:

$$Al_2O_3(s)+6H(\text{Al melt})\rightarrow 2Al(l)+3H_2O(g) \quad (8)$$

where (s), (l) and (g) respectively indicate solid, liquid and gas phase, and (Al melt) indicates aluminium of the bath of molten aluminium.

Thus, the presence of hydrogen facilitates aluminium metal production efficiency.

Technologically, it is possible to use a carbonaceous material comprising hydrocarbon material, such as methane, as the sole source of carbon in the process of the present invention. For this option, the methane rate for example for a 50,000 ton/year aluminium production installation would be about 9500 $Nm^2$/hour and an off-gas volume of 28,500 $Nm^2$/hour. These volumes of gas can be managed in a reactor as large as, for example, a steel converter with a 100 to 110 tonnes capacity; that is, a small converter in steel production technology.

Figure 3:
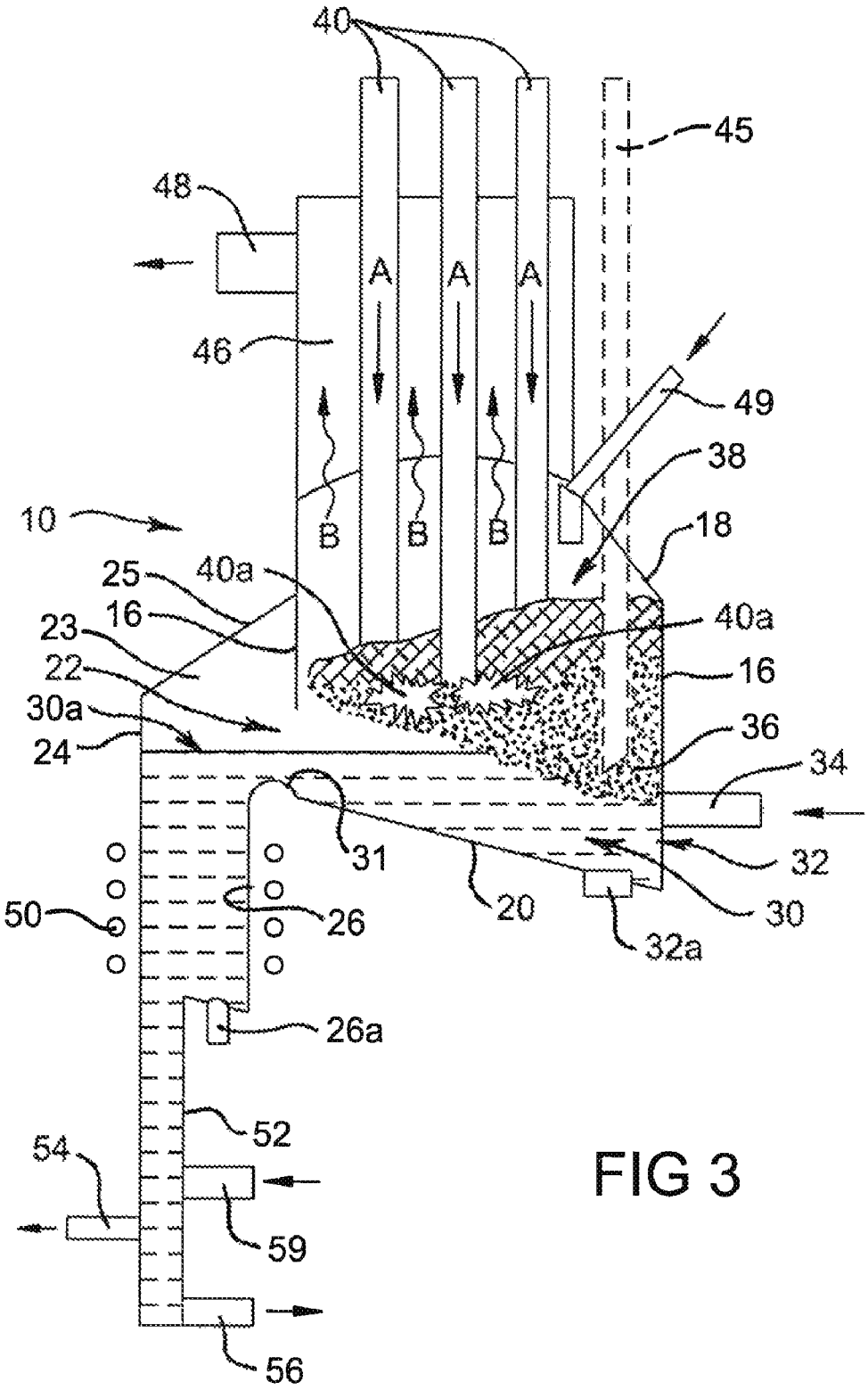
FIG. 3 is a schematic sectional view of a reactor installation for use in the process of the present invention.

The drawing of FIG. 3 shows a reactor installation 10 which includes a peripheral wall 16 which has the form of a truncated cylinder. Thus wall 16 has upper and lower edges which are in approximately parallel planes inclined with respect to the upright axis of the cylinder. At the upper edge of wall 16 the installation has a domed cover 18. At the lower edge of wall 16, the installation has an inclined base or hearth 20. An arcuate opening 22 is defined between the base 20 and the lower edge of wall 16 due to base 20 being inclined more shallowly than the plane containing the lower edge of wall 16. Outwardly from opening 22, installation 10 has an arcuate chamber 23 defined by a wall 24 and, between the upper edge of wall 24 and wall 16, a cover 26. While not shown, base 20 continues beyond wall 16 to join the lower edge of wall 24. The chamber 23 communicates through an opening in base 20 with a cylindrical sub-chamber 26 which extends below base 20 and chamber 23, outwardly from wall 16.

The installation 10 holds a bath 30 of molten aluminium having an upper surface 30*a* of which can rise and fall within the height of opening 22. The lower level for surface 30*a* is set by a weir 31 defined by base 20 at the opening to sub-chamber 26. The aluminium of bath 30 fills sub-chamber 26 and a first reactor 32. In the reactor installation 10, the first reactor 32 is in the volume occupied by the molten aluminium inwardly with respect to wall 16 from opening 22. The reactor 32 has an inlet 34 enabling injection into the molten aluminium. While not shown, the inlet 34 is in the form of an arcuate manifold providing a circumferential array of openings through and around part of the circumference of wall 16, to enable simultaneous injection through each opening.

In use of installation 10, the molten aluminium in first reactor 32 is maintained at a superheated temperature preferably above 1400° C., and more preferably in the range of 1550° C. to 1650° C. Through each opening of inlet 34 to the reactor 32, there is injected into the superheated molten aluminium a stream having alumina entrained in a carrier fluid, the stream including a carbonaceous material which is a hydrocarbon material, or is produced by pyrolysis, decomposition or cracking of a hydrocarbon material, providing a source of carbon. The carbon of the injected streams reacts with the molten aluminium to form solid aluminium carbide by the reaction of equation (5) or a combination of the reactions of equations (7) and (4). The carrier fluid may be a hydrocarbon or a mixture of a hydrocarbon and at least one of argon and hydrogen. The hydrocarbon may be a gas at ambient temperatures, or a liquid or solid at ambient temperatures but able to produce a suitable gas when heated for or during injection. The carbon may at least partially be provided by the hydrocarbon, such as detailed earlier herein, which is pyrolyzed, decomposed or cracked before or when injected into the superheated aluminium. Carbon provided by decomposition or cracking of the hydrocarbon will be in very fine particle sizes. The particles of alumina and, where provided, the particles of carbon, preferably have a maximum dimension not greater than about 5 mm. The particles more preferably are from 2 to 4 mm, although they may be smaller down to about 20 μm.

The solid aluminium carbide formed in the first reactor 32 aggregates with injected alumina, while some molten aluminium and gas is trapped in the aggregated material. The gas may be the carrier gas where this is argon or hydrogen, or hydrogen produced by decomposition or cracking of hydrocarbon carrier gas. The aggregated material has an apparent or bulk density such that it rises to form a mass 36 of solid aluminium carbide containing product at the surface of the molten aluminium.

The installation 10 has a second reactor 38 located within peripheral wall 16, above the first reactor 32. The mass 36 projects above the molten aluminium in reactor 32 into the reactor 38. Extending down through the domed cover 18, reactor 38 includes a plurality of consumable graphite electrodes 40. These are operable to provide electric arc heating, as depicted schematically by the "arcs" 40*a*, to heat the mass 36 above the temperature in reactor 32. The electric arc heating is conducted to generate intense localised heating of mass 36 which, as it progresses, becomes submerged heating. For this, the electrodes preferably are grouped, such as somewhat centrally with respect to the axis of the cylindrical form of wall 16. From the intense localised heating, the temperature of mass 36 decreases towards wall 16 at which it may be as low as about 1000° C., but preferably not lower than about 1300° C. This enables the main body or volume of mass 36 to be at a temperature of from about 1700° C. to about 2000° C., to react the aluminium carbide and alumina of the mass 36 in accordance with equation (2), to produce molten aluminium with liberation of carbon monoxide.

The aluminium metal produced by the heating of mass 36 by electric current supplied by electrodes is able to trickle down through mass 36 to the molten aluminium of the bath 30 in the first reactor 32. This is enabled by mass 36 having sufficient porosity, and also by gaps between the periphery of mass 36 and wall 16.

The reaction of equation (2) is able to proceed at a sufficient rate despite the temperature of mass 36 generally being from about 1700° C. to about 2000° C. Temperatures in this range are low relative to the temperature levels in prior art processes such as detailed in the references above. The kinetics of the reaction are enhanced by gases evolved from reactor 32 rising through mass 36 in reactor 38 and sweeping away carbon monoxide generated by the reaction. This removal of carbon monoxide preferably is assisted by the electrodes 40 being hollow, with argon or hydrogen being provided from a source of supply connected to the upper end of each electrode 40. The gas from the supply flows through the length of each electrode 40, as depicted by arrows A, to the site of the respective generated arc.

The electrodes may be connected to a supply of alternating electric current, with arcing being between adjacent electrodes. Alternatively, the electrodes may be connected to a direct current supply, with arcing being maintained by electrode 46, shown in broken outline. The electrode 45 penetrates further into mass 36 and preferably is water cooled.

Despite the relatively low temperature at which aluminium metal is recovered in reactor 38, some aluminium vapour will be evolved. The extent to which this occurs is low relative to the prior art of the above references. However, it still is sufficient to warrant procedures for capturing the evolved metal. While not illustrated, the area of the domed cover 18 of installation 10 is perforated between a respective opening substantially filled by each electrode 40. The perforations allow some evolved aluminium vapour to escape into a chamber 46 located over dome 18, as depicted by arrows B. The vapour expands in chamber 46 and consequently cools to a temperature at which it is substantially prevented from being oxidised by the reaction:

$$6Al+3CO \rightarrow Al_2O_3+Al_4C_3 \quad (9)$$

Also, the reaction of equation (9) is made less favourable by the dilution of carbon monoxide by gases which sweep the carbon monoxide from reactor 38. As a consequence, aluminium vapour which passes through the domed cover 18 is able to be condensed as aluminium metal, with little oxidation.

To the extent that reaction of equation (9) is able to proceed, it will tend to occur in the space of reactor 38 below cover 18, due to a higher temperature prevailing in that space than beyond cover 18. Also, the products will tend to collect on the underside of cover 18. Deposits formed in this way eventually will break away from cover 18. Thus, the collected deposits will fall back to mass 36 to enable recovery of its aluminium content.

Chamber 46 has an outlet 48 through which gases are drawn by a vacuum source (not shown) connected to outlet 48. Thus, a reduced pressure is maintained in chamber 46 and, hence, in reactor 38. This reduced pressure directly facilitates removal of carbon monoxide from the regions of mass 36 at which the reaction of equation (2) is occurring. Also, the reduced pressure in reactor 38 increases the rate at which gas from reactor 32 is drawn through mass 36, to further enhance removal of carbon monoxide. As indicated, these factors improve the kinetics of the reaction of equation (2), enabling it to proceed effectively at a relatively low temperature of from about 1700° C. to 2000° C.

Over a period of operation, an imbalance can occur between the ratio of aluminium carbide to alumina in the mass 36 in reactor 38. A make-up amount of any reactant then is able to be supplied onto mass 36 via inlet 49.

The aluminium of bath 30 is able to be maintained at a superheated temperature above 1400° C., preferably in the range of 1550° C. to 1650° C., by an induction heating coil 50 provided around sub-chamber 26. Other heating means can be provided, if required to ensure that all aluminium of bath 30 is at a sufficient superheated temperature. In particular, it is appropriate that the region of bath 30 below reactor 38, in which the production of solid aluminium carbide results from the injection of carbonaceous material hydrocarbon and alumina, is at a sufficient temperature above 1400° C., preferably 1550° C. to 1650° C.

With molten aluminium trickling through mass 36 to the bath 30, the volume of bath 30 progressively increases. It therefore is necessary to tap aluminium product from installation 10. For this purpose, a discharge pipe 52 extends downwardly from the base of sub-chamber 26 to a tapping outlet 54. The pipe 52 preferably is cooled to lower the temperature of the aluminium therein, with water cooling being preferred.

The discharge outlet 54 is located a short distance above the lower end of pipe 52. This is to enable dross settling from aluminium in sub-chamber 26 and pipe 52 to collect in pipe 52 below outlet 54. A further outlet 56 at the lower end of pipe 52 is provided to enable dross discharge from time to time.

Reactor 32 has a drainage outlet 32*a*, while sub-chamber 26 also has a drainage out 26*a*. In each case, this is to enable complete removal of molten metal, such as to enable servicing of installation 10.

As will be appreciated, hydrogen solubility is very low in solidified aluminium but high in molten aluminium and very high in superheated molten aluminium. Thus, with use of the carbonaceous material hydrocarbon in the injected stream, a substantial proportion of hydrogen produced by pyrolysis, decomposition or cracking of the hydrocarbon will go into solution in the superheated molten aluminium. The same will apply to hydrogen used as a carrier gas, such as for a particulate solid hydrocarbon.

Purging or scavenging of hydrogen by argon can be achieved by use of argon injected into pipe 52 through an inlet 59, so as to rise up through pipe 52 and carry displaced hydrogen with it. Thus, overall, it is preferred that all gases are exhausted through outlet 48 to enable recovery, recycling or re-use.

Finally, it is to be understood that various alterations, modifications and/or additions may be introduced into the constructions and arrangements of parts previously described without departing from the spirit or ambit of the invention.

The invention claimed is:

1. A process for producing a mass of solid aluminium carbide containing product, wherein the process includes the steps of:

(a) injecting particulate alumina into a bath of molten aluminium metal;

(b) injecting carbonaceous material consisting of, containing or yielding carbon, into the bath of molten aluminium metal;

(c) maintaining the bath of molten aluminium metal at a superheated temperature sufficient to heat and react carbon of the carbonaceous material with molten aluminium of the bath to produce solid aluminium carbide which mixes with alumina to form a mass containing entrapped gas and entrapped molten aluminium metal and having a bulk or apparent density less than the aluminium of the bath; and (d) allowing the mass of solid aluminium carbide mixed with alumina, containing gas and aluminium metal, to accumulate as a mass of solid aluminium carbide containing product on the upper surface of the bath, wherein the carbonaceous material is a hydrocarbon material or is produced by pyrolysis, decomposition or cracking of a hydrocarbon material.

2. The process of claim 1, wherein the particulate alumina has a maximum particle size of about 5 mm.

3. The process of claim 1, wherein the hydrocarbon material also contains particulate carbon.

4. The process of claim 3, wherein the particulate carbon has a maximum particle size of about 5 mm.

5. The process of claim 1, wherein the carbon of the carbonaceous material is at least partially provided by a carrier gas comprising a hydrocarbon material which is decomposed or cracked to yield carbon and hydrogen on or before being injected into the bath.

6. The process of claim 1, wherein the carbon of the carbonaceous material is provided by a combination of particulate carbon entrained in the hydrocarbon material which is decomposed or cracked to yield carbon and hydrogen on or before being injected into the bath.

7. The process of claim 5, wherein the hydrocarbon is mixed with argon, hydrogen or a mixture of argon and hydrogen.

8. The process of claim 1, wherein the bath of molten aluminium is superheated to a temperature in excess of 1400° C.

9. The process of claim 8, wherein the temperature is from about 1550° C. to 1650° C.

10. The process of claim 1, wherein the hydrocarbon comprises at least one of methane, ethane, butane, pentane, higher alkanes, natural hydrocarbon gases, petroleum bases, petroleum liquids, alkenes and tar pitch.

11. A process for the recovery of aluminium metal, wherein aluminium carbide containing product is produced in a first zone by the process of claim 1, and the aluminium carbide containing product is heated in a second zone to react the aluminium carbide and alumina of the product to produce aluminium metal and carbon monoxide.

12. The process of claim 11, wherein the second zone is above the first zone such that, as the aluminium carbide containing product accumulates on the upper surface of the bath, the product is able to enter the second zone.

13. The process of claim 11, wherein the heating in the second zone is by induction heating.

14. The process of claim 11, wherein the heating in the second zone is by electric arc heating.

15. The process of claim 14, wherein the heating is by a plurality of electrodes arranged such that each electrode generates an arc at the upper part of the aluminium carbide containing product to provide a region of intense local heating at which the aluminium carbide and alumina of the product are caused to react.

16. The process of claim 15, wherein a main body of the aluminium carbide containing product around the electrodes is heated to a temperature of from about 1700° C. to about 2000° C.

17. The process of claim 11, wherein carbon monoxide is removed from the upper surface of the aluminium carbide containing product and from the region of intense local heating.

18. The process of claim 17, wherein the carbon monoxide is removed at least partially by maintaining a sufficiently low pressure in the second zone, above the aluminium carbide containing product.

19. The process of claim 17, wherein the carbon monoxide is removed at least in part by flushing the upper surface of the aluminium carbide containing produce with argon, hydrogen or a combination or argon and hydrogen.

20. The process of claim 11, further comprising maintaining a reduced pressure above the aluminium carbide containing produce in the second zone.

21. The process of claim 20, wherein the reduced pressure causes argon, hydrogen or a mixture of argon and hydrogen to be drawn upwardly from the first zone, through the aluminium carbide containing product.

* * * * *